US006721969B1

(12) United States Patent
Lupo et al.

(10) Patent No.: US 6,721,969 B1
(45) Date of Patent: Apr. 20, 2004

(54) MULTIPLE USE BUNK BED

(76) Inventors: Anthony C. Lupo, Benchmark of Fla., 915 Cornwall Rd., San Ford, FL (US) 32773; Bryan L. Smith, Box 30 East Irvine, East Irvine, CA (US) 92650

( * ) Notice: Subject to any disclaimer, the term of this patent is extended or adjusted under 35 U.S.C. 154(b) by 0 days.

(21) Appl. No.: 10/342,629

(22) Filed: Jan. 14, 2003

(51) Int. Cl.[7] ..... A47C 13/18
(52) U.S. Cl. ..... 5/9.1; 5/2
(58) Field of Search ..... 5/2.1, 8, 9.1, 18.1

(56) References Cited

U.S. PATENT DOCUMENTS

| | | | | | |
|---|---|---|---|---|---|
| 2,888,687 | A | * | 6/1959 | Lindsey | 5/2.1 |
| 3,633,224 | A | | 1/1972 | Millier | |
| 3,858,253 | A | | 1/1975 | Lauzon | |
| 3,896,512 | A | | 7/1975 | Black | |
| 4,070,715 | A | * | 1/1978 | Reppas | 5/2.1 |
| 4,237,563 | A | | 12/1980 | Ollerman | |
| 4,253,204 | A | * | 3/1981 | Tasaka | 5/2.1 |
| 4,450,597 | A | | 5/1984 | Hull | |
| D277,433 | S | | 2/1985 | Hull | |
| D403,525 | S | | 1/1999 | Zaidman | |
| 5,983,420 | A | | 11/1999 | Tilley | |

* cited by examiner

*Primary Examiner*—Teri Pham Luu
*Assistant Examiner*—Fredrick Conley
(74) *Attorney, Agent, or Firm*—Richard C. Litman

(57) ABSTRACT

A multiple-use bunk bed has a top bunk (1) and a trundle bunk (2) positioned intermediate a first bedstead (3) and a second bedstead (4). The trundle bunk includes casters (5) on which the trundle bunk is adapted to be positioned intermediate a bottom of the first bedstead and a bottom of the second bedstead in a non-use mode and to be rolled out from between them for a use mode that includes use for sleeping. Vertically above the trundle bunk and under the top bunk intermediate the bedsteads are a desktop (6), shelves (11) and drawers (12). A closet (8) with a closet door (10) is positioned intermediate a back of the bunk bed and a closet wall (9) at an inside of the desktop. The drawers can include left-side drawers, right-side drawers, central drawers and bottom drawers. The multiple-use bunk bed can include single, regular, queen, king and special sizes. Size adaptations are made with positioning of support beams (13, 23) for bottom-support embodiments and with width of hanging-support walls (14) for hanging-support embodiments.

34 Claims, 12 Drawing Sheets

MULTIPLE USE BUNK BED

BACKGROUND OF THE INVENTION

This invention relates to a bunk bed having multiple uses for efficient use of space in dormitories, youth bedrooms, apartments, cabins, working areas, small houses and other small living quarters.

There are known bunk beds with multiple uses to economize space, but none which utilize a top bunk bed in working relationship to a trundle bed with case goods, such as drawers, shelves and a closet, elevated above the trundle bed and below the bunk bed in a convenient and effective structure for dormitory, bedroom, cabin, ship, beach-house, garage and work-place positioning for studying, enjoying music, relaxation, sleeping, storing clothes, storing office supplies and supporting computers with one article of furniture in a manner taught by this invention.

Examples of most-closely related known but different devices are described in the following patent documents:

| U.S. Patent No. | Inventor | Issue Date |
|---|---|---|
| 5,983,420 | Tilley | 11/16/1999 |
| Des. 403,525 | Zaidman | 01/05/1999 |
| 4,450,597 | Hull | 05/29/1984 |
| Des. 277,433 | Hull | 02/05/1985 |
| 4,237,563 | Ollerman | 12/09/1980 |
| 3,896,512 | Black | 07/29/1975 |
| 3,633,224 | Millier | 01/11/1972 |
| 3,858,253 | Lauzon | 01/07/1975 |
| 2,907,053 | Fox | 10/06/1959 |

SUMMARY OF THE INVENTION

Objects of patentable novelty and utility taught by this invention are to provide a multiple-use bunk bed which:

- can be used conveniently and attractively for at least two people in a small room for sleeping, studying, camping, computer working, office working and living generally;
- can be combined with efficiency kitchen and toilet facilities in the small room for dormitory, efficiency-apartment, cabin or temporary living facilities;
- is ideal for student use at home, in a dormitory or in rooms of a home rented to students near an educational facility or to workers near a place of employment;
- can be packaged for commercial distribution for professional contract installation in multiple-unit dwellings, dormitories, cabins and beach houses;
- can be packaged for commercial distribution to individuals for lay-person installation in youth bedrooms, cabins, garages, beach houses and other structures for economizing space;
- can be adapted for extended width and extended length for larger people, for a plurality of people on each bunk and for increased multiple-use space,
- can be assembled by two people with only a Phillips screwdriver in one hour; and
- is inexpensive and durable.

This invention accomplishes these and other objectives with a multiple-use bunk bed having a top bunk and a trundle bunk positioned intermediate a first bedstead and a second bedstead that are oriented vertically at ends of the bunk bed. The top bunk includes a top-bunk framework positioned intermediate a top portion of a first bedstead and a top portion of a second bedstead. The trundle bunk includes casters on which the trundle bunk is adapted to be positioned intermediate a bottom of the first bedstead and a bottom of the second bedstead in a non-use mode and to be rolled out from intermediate the bottom of the first bedstead and the bottom of the second bedstead for a use mode that includes use for sleeping. Vertically above the trundle bunk and under the top bunk intermediate the first bedstead and the second bedstead are a selection of items which can include a desktop, a keyboard shelf, book shelves, disk shelves, computer shelves, a writing-instrument drawer and clothing drawers. A clothing closet with an entrance door in a bedstead is positioned intermediate a back of the bunk bed and a desk-top wall. The desktop can be extended intermediate drawers at a first end and a bedstead at a second end of the desktop for single use or, optionally for use by two people, the desktop can be extended a full distance between the bedsteads. The desktop can include a pullout portion. With these and other optional features, this multiple-use bunk bed is novelly meritorious for space-saving uses during educational, recreational, working and other variously applicable periods of lives of a significant portion of society.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
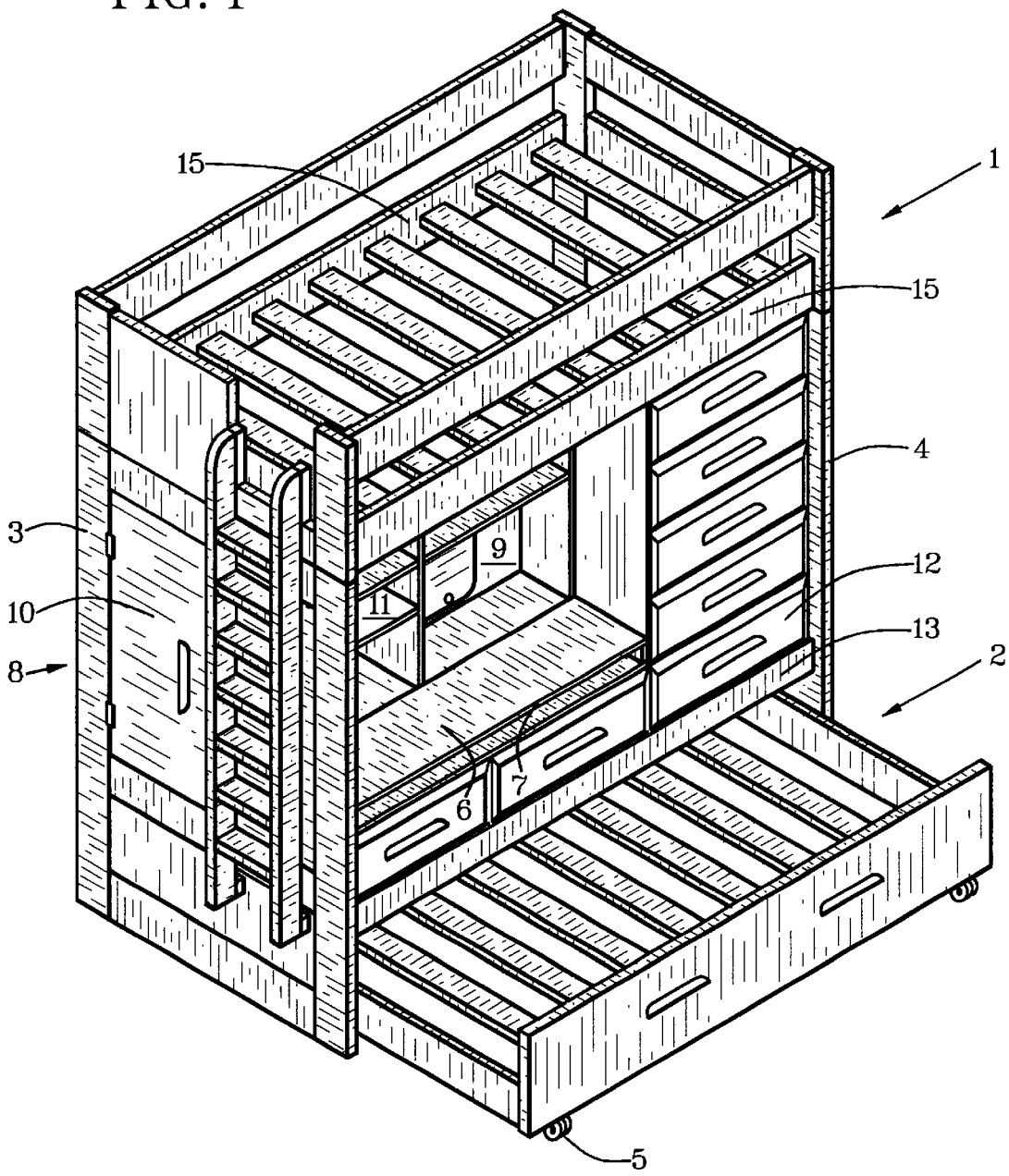
FIG. 1 is a perspective view of an embodiment of the multiple-use bunk bed having right-side drawers and showing a trundle bunk pulled partway out.

Listed numerically below with reference to the drawings are terms used to describe features of this invention. These terms and numbers assigned to them designate the same features throughout this description.

1. Top bunk
2. Trundle bunk
3. First bedstead
4. Second bedstead
5. Casters
6. Desktop
7. Front edge
8. Closet
9. Closet wall
10. Closet door
11. Shelves
12. Drawers
13. Support beams
14. Hanging-support wall
15. Top-bunk beams
16. Wall hanger
17. First end
18. Second end
19. Attachment member
20. Pullout portion
21. Desktop supports
22. Drawer supports
23. Crosswise support beams Referring to FIGS. 1–2, a multiple-use bunk bed has a top bunk 1 and a trundle bunk 2 positioned intermediate bedsteads which include a first bedstead 3 and a second bedstead 4 that are oriented vertically at ends of the bunk bed. The top bunk 1 includes a top-bunk 1 framework positioned intermediate top portions of the bedsteads. The trundle bunk 2 includes casters 5 on which the trundle bunk 2 is adapted to be positioned intermediate a trundle-bunk portion of the bottom of the first bedstead 3 and a trundle-bunk portion of a bottom of the second bedstead 4 in a non-use mode on a floor and to be rolled out from intermediate the bottom of the first bedstead 3 and the bottom of the second bedstead 4 on the floor for a use mode that includes use for sleeping.

At least one desktop 6 is positioned vertically above the trundle bunk 2 and under the top bunk 1. The desktop 6 has a front edge 7 proximate front edges of the bedsteads. The desktop 6 has an aft edge predeterminedly rearward from proximate the front edges of the bedsteads.

A closet 8 is positioned predeterminedly intermediate aft edges of the bedsteads and an aft edge of the desktop 6. The closet 8 has a closet wall 9 proximate the aft edge of the desktop 6 and extended vertically intermediate the desktop 6 and the top-bunk framework. The closet 8 has a closet door 10 in at least one of the bedsteads.

One or more shelves 11 are positioned selectively intermediate the desktop 6 and the top-bunk 1 framework.

A plurality of drawers 12 are positioned predeterminedly intermediate the trundle bunk 2 and the top-bunk 1 framework.

Figure 8:
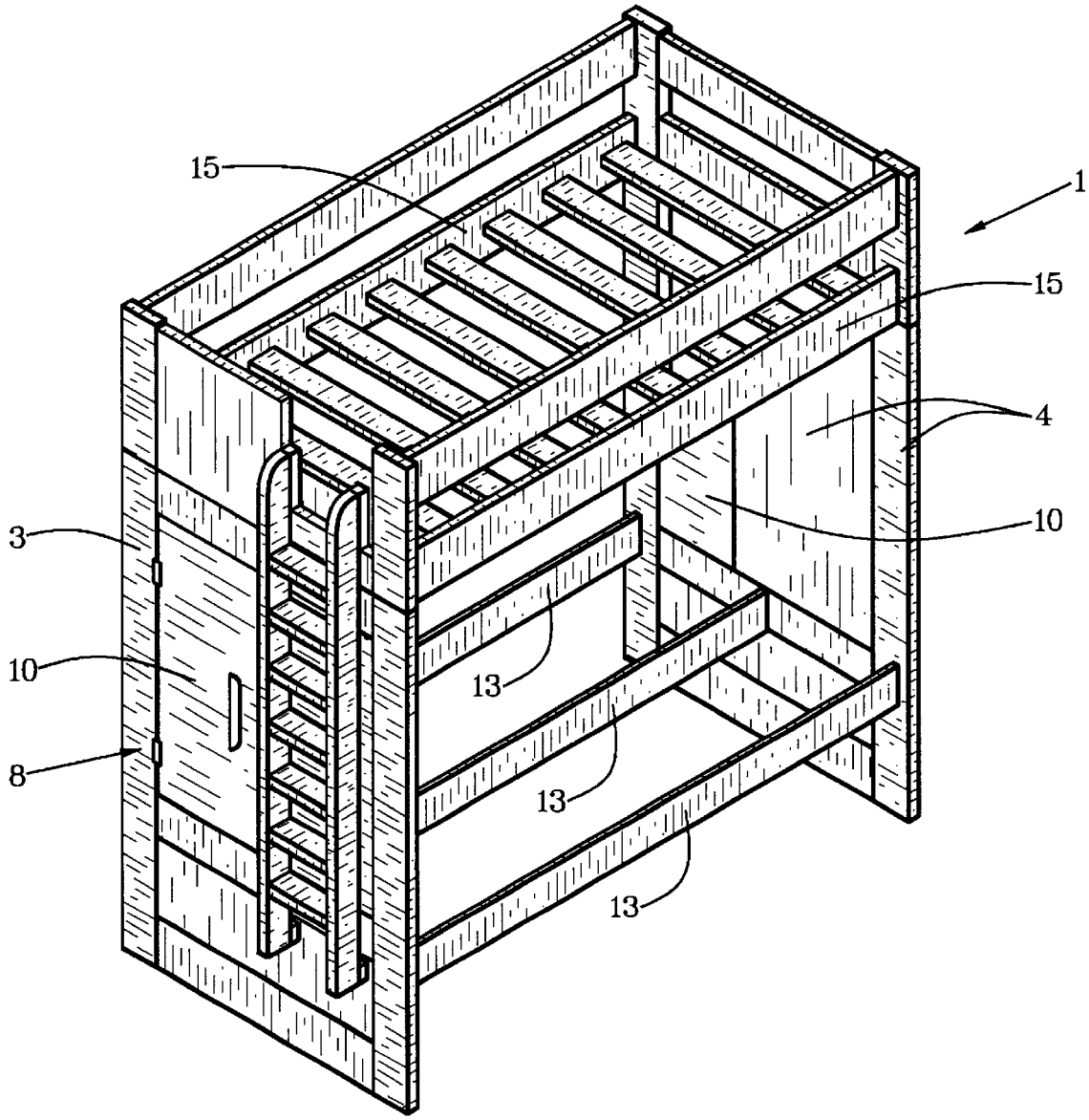
FIG. 8 is a perspective view of framework for embodiments that support the drawers and desktops with lengthwise bottom beams.

A vertical support is adapted predeterminedly for supporting the desktop 6, the shelves 11, the drawers 12 and contents thereof. The vertical support can include support beams 13 as shown in FIG. 8 for bottom support of the desktop 6, the shelves 11, the drawers 12 and contents thereof for the embodiments shown in FIGS. 1–5. The support beams 13 can include a set of three support beams 13 juxtaposed intermediate a front side of the bunk bed and an aft edge of the bunk bed. The three support beams 13 are extended intermediate the first bedstead 3 and the second bedstead 4 to which the three support beams 13 are attachable, support being transmitted to bottom portions of the bedsteads 3 and 4 by attachment of the three support beams 13 to the bedsteads 3 and 4. A support beam 13 proximate front edges of the bedsteads 3 and 4 provides front support and an intermediate support beam 13 provides aft support of the desktop 6, the shelves 11, the drawers 12, the contents thereof and the closet wall 9, leaving space for the closet 8 between the intermediate support beam 13 and an aft support beam 13. A set of two of the support beams 13 that include the front-edge support beam 13 and the intermediate support beam 13 can be employed if rigidity and structural integrity of the multiple- use bunk bed is provided by other bracing support.

Figure 14:
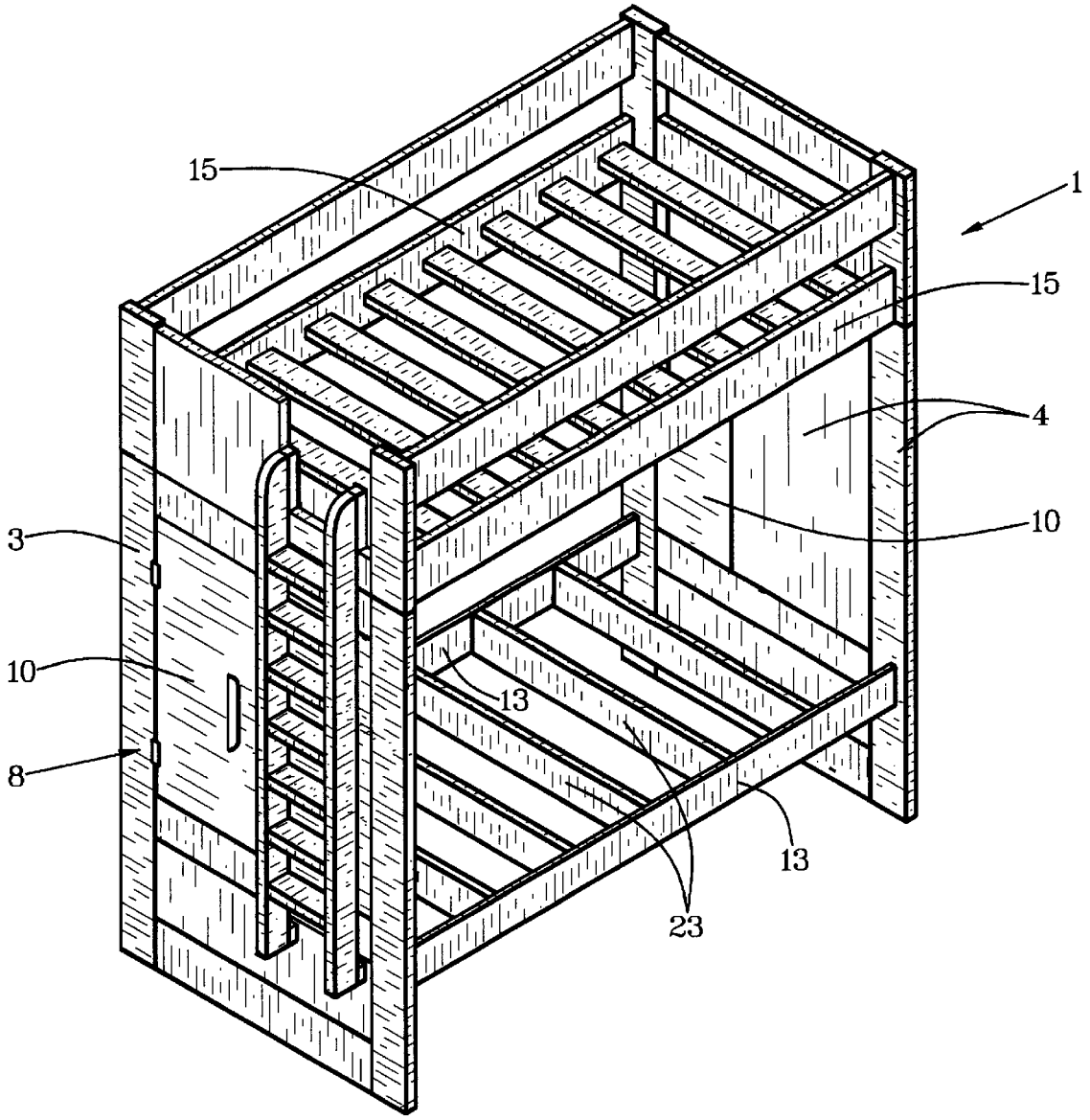
FIG. 14 is a perspective view of framework for embodiments that support the drawers and desktop with crosswise beams between aft and front edge lengthwise bottom support beams.

Referring to FIG. 14, an alternate support means for supporting the case goods (e.g., desktop, shelves, drawers) above the trundle bed 2 is shown using crosswise support beams 23 secured between the aft and front edge support beams 13.

Referring to FIGS. 6–7 and 9–13, the vertical support can include optionally a hanging-support wall 14 that is hung from top-bunk beams 15 of the top-bunk 1 framework with at least one wall hanger 16 intermediate the first bedstead 3 and the second bedstead 4. The hanging-support wall 14 saves work-use space at the bottom by transferring support to the top-bunk beams 15 that can be larger and sturdier, if need be, without interference with multiple use of the multiple-use bunk bed.

Figure 6:
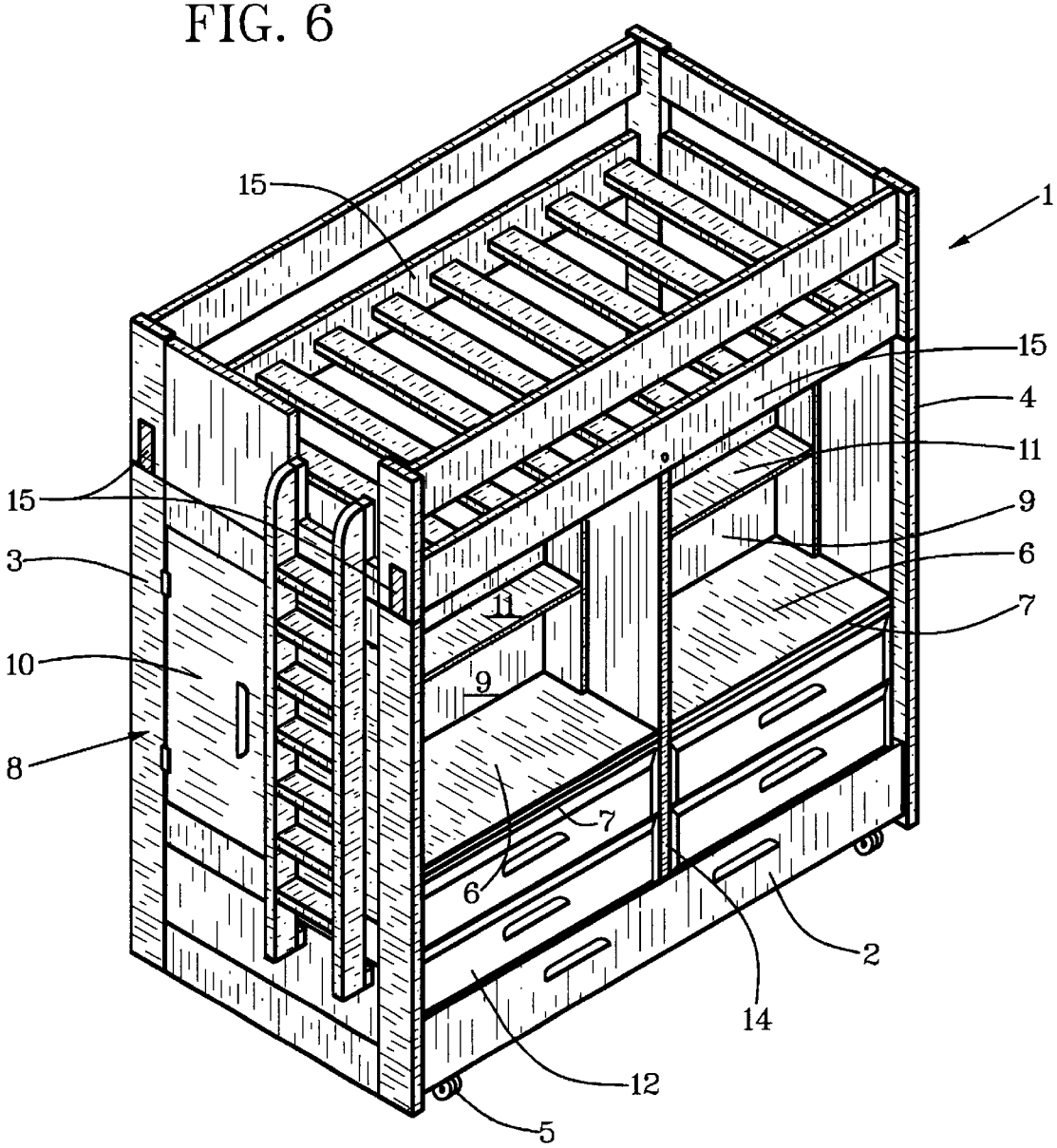
FIG. 6 is a perspective view of an embodiment of the multiple-use bunk bed having two sets of bottom drawers and two desktops divided by a hanging-support wall.
Figure 7:
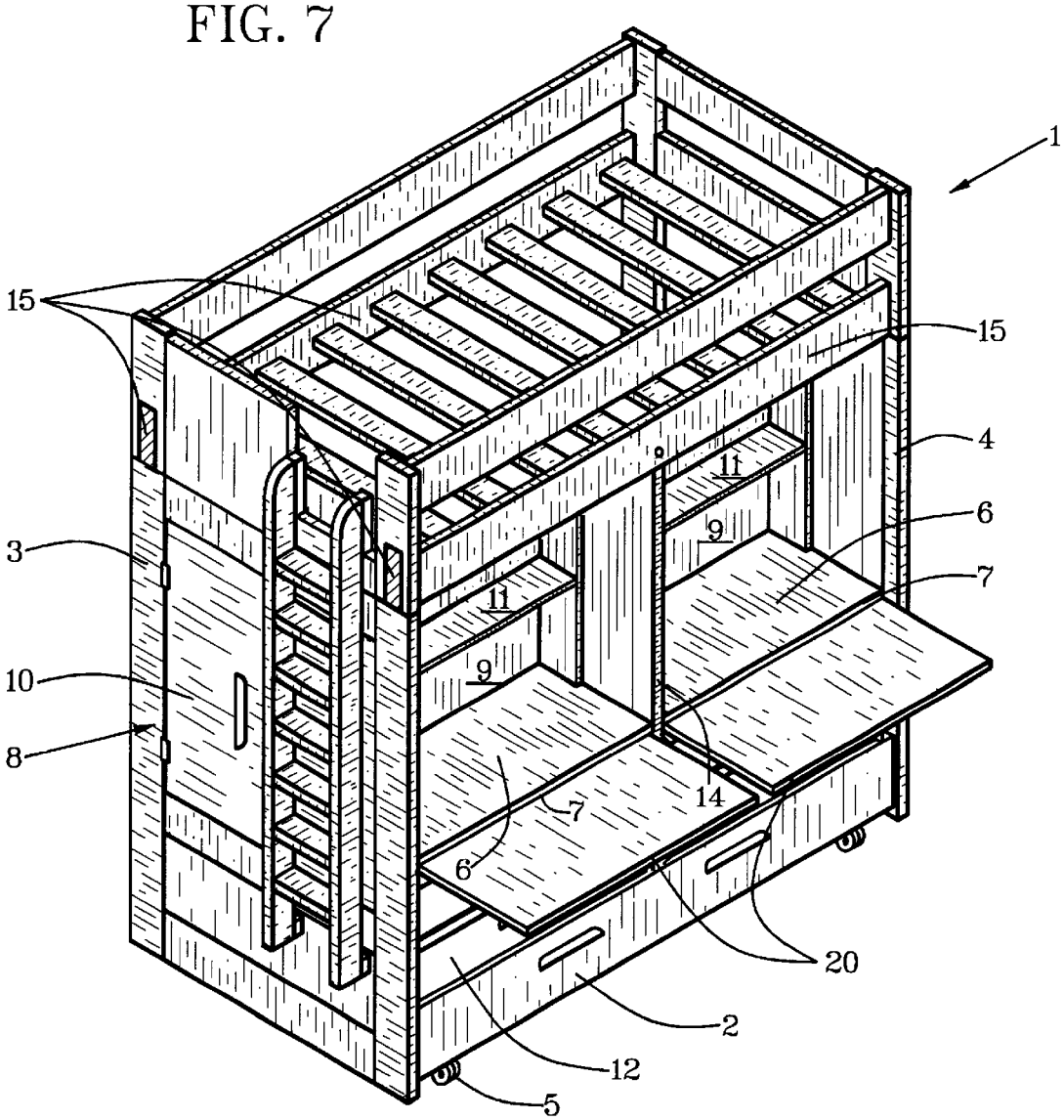
FIG. 7 is the FIG. 6 illustration with two desk tables pulled out over the two sets of bottom drawers.
Figure 9:
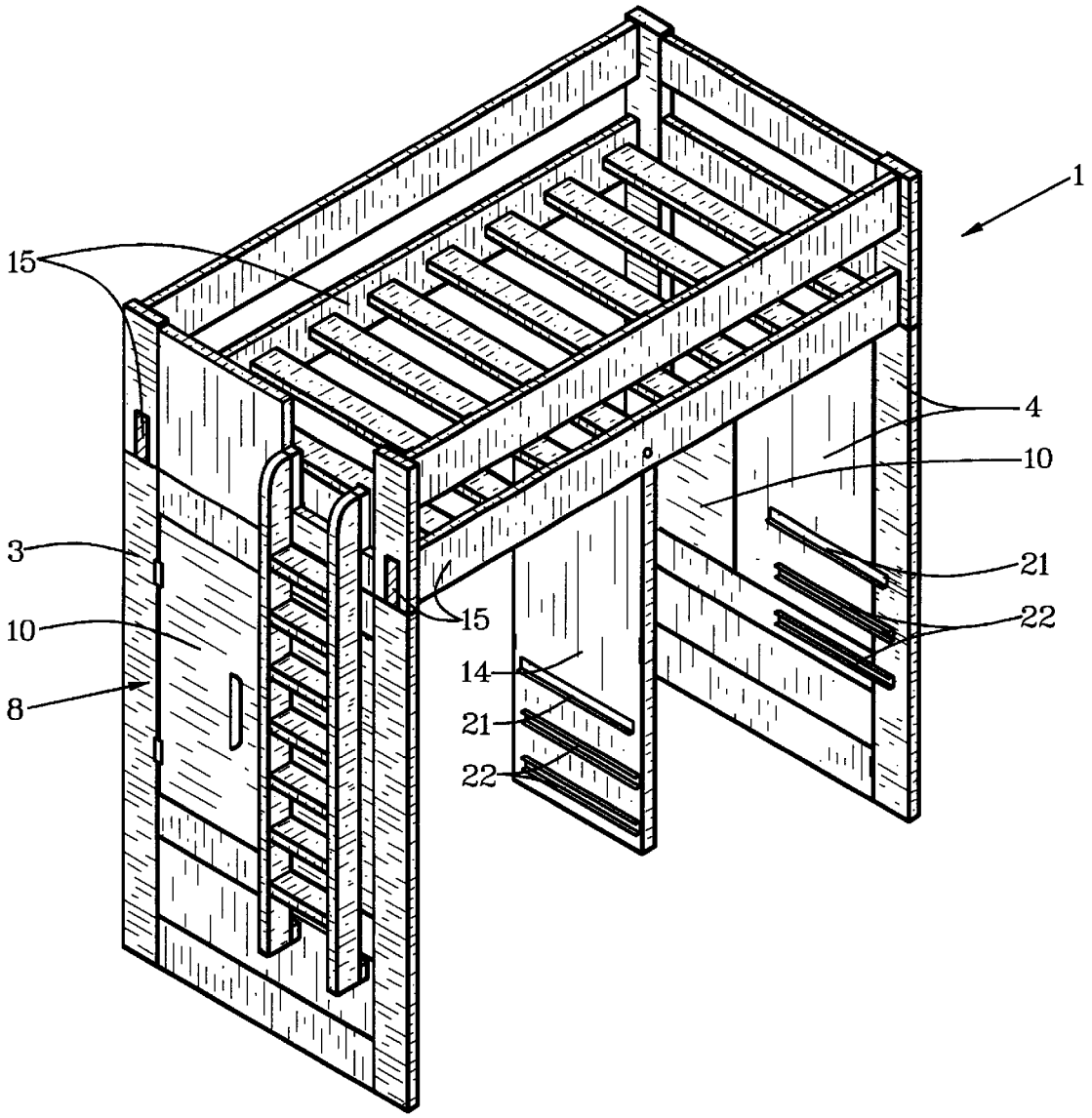
FIG. 9 is a perspective view of framework for embodiments that support the drawers and desktops with a hanging-support wall suspended from top beams and with wall-side support.
Figure 10:
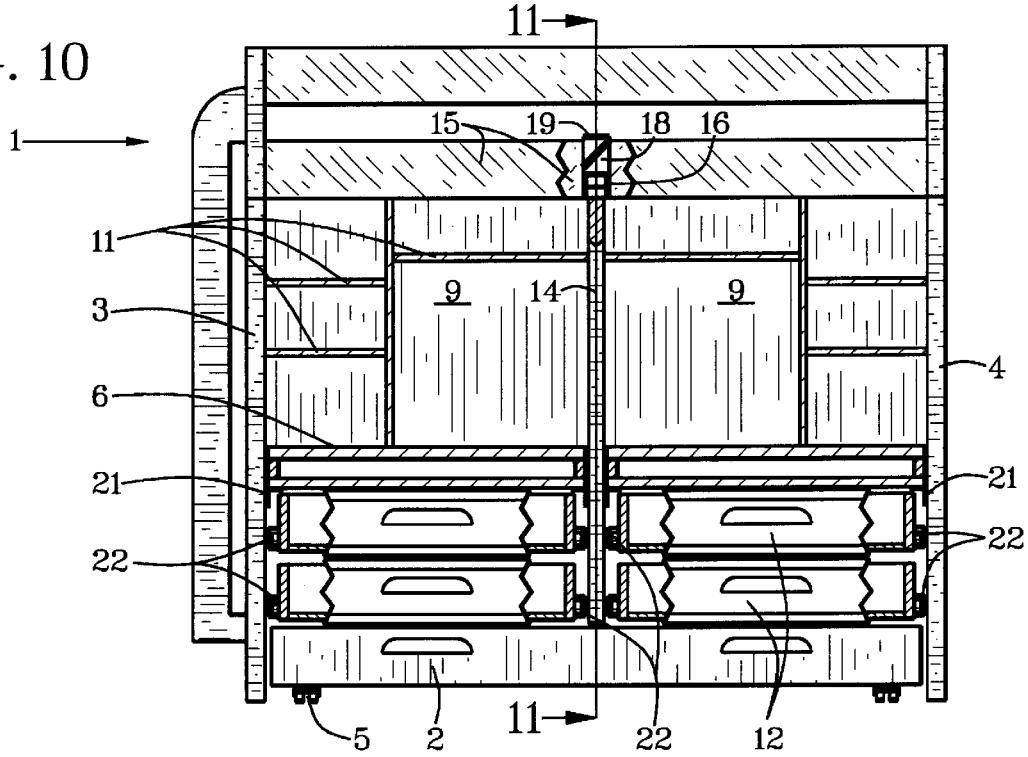
FIG. 10 is a partially cutaway front view of the embodiment having support of the drawers, desktop and shelves with the hanging-support wall from the top beams and with the wall-side support.
Figure 11:
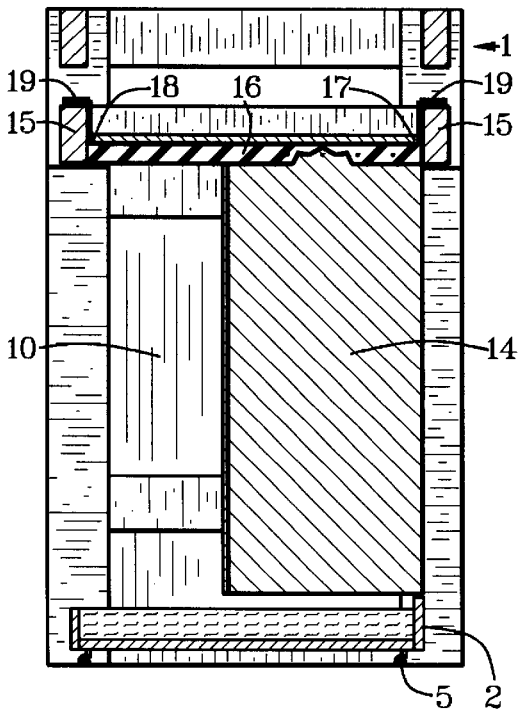
FIG. 11 is an end view of the FIG. 10 illustration taken through section line 11—11 of FIG. 10.

The wall hanger 16 can include a first end 17 that is attached to a first top-bunk beam 15 and a second end 18 that is attached to second top-bunk beam 15. The wall hanger 16 is preferably a channel iron with a channel into which a top end of the hanging-support wall 14 is inserted and bolted between channel walls. Attachment members 19 on the first end 17 and on the second end 18 of the wall hanger 16 can be bolted to the top-bunk beams 15 as depicted in FIGS. 6–7 and 9 or preferably bent orthogonally onto top edges of the top-bunk beams 15 as shown in FIGS. 10–13. The attachment members 19 have tensile strength and strength of attachment to the top-bunk beams 15 for transmitting vertical support for the hanging-support wall 14 to the top-bunk beams 15.

The multiple-use bunk bed with the closet 8 behind the desktop 6, shelves 11 and drawers 12 is made possible by commonality of vertical support from the bottom with the support beams 13 and, optionally, from the top with the hanging-support wall 14.

Figure 2:
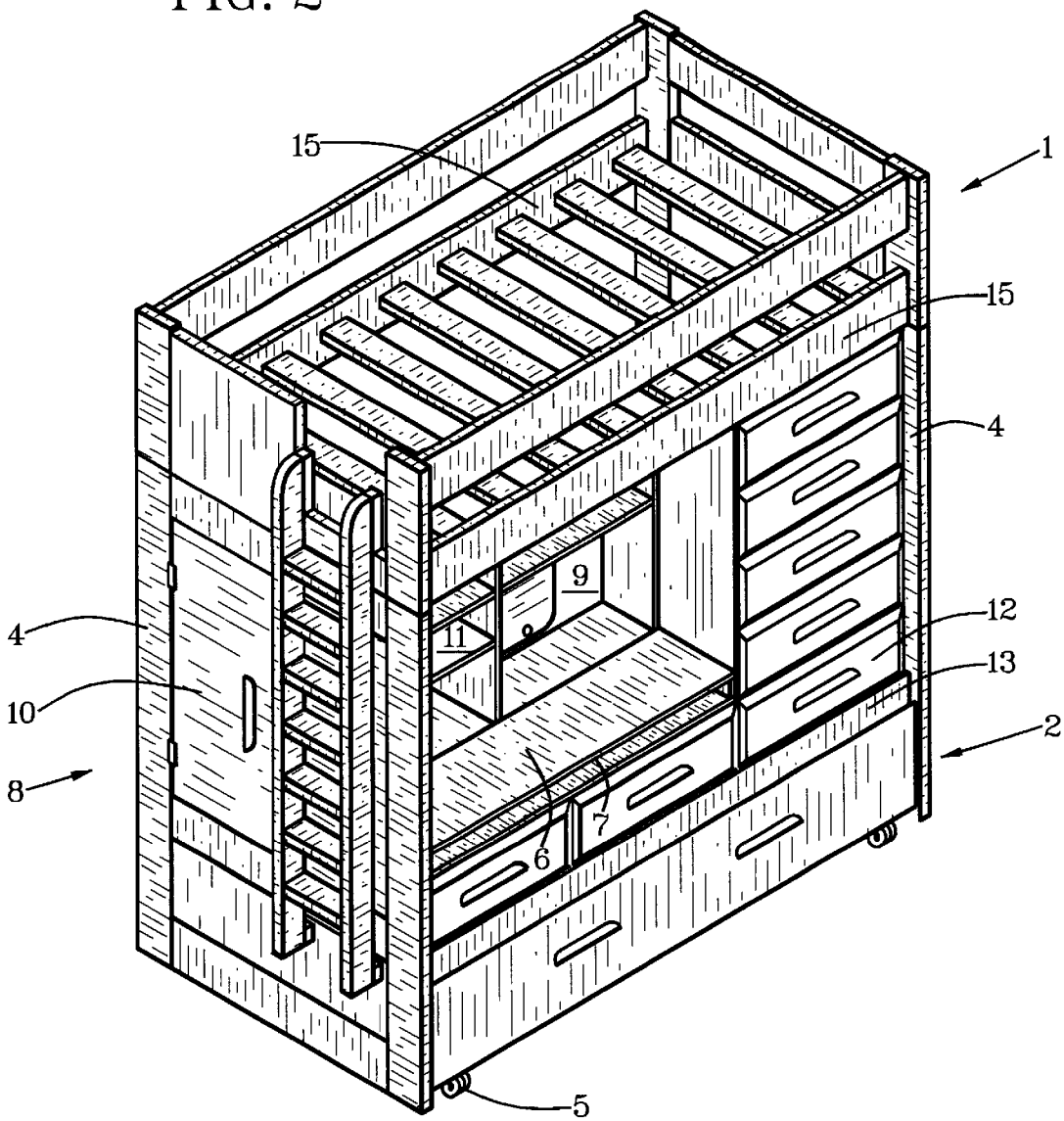
FIG. 2 is the FIG. 1 illustration with the trundle bunk rolled under bottom drawers.
Figure 3:
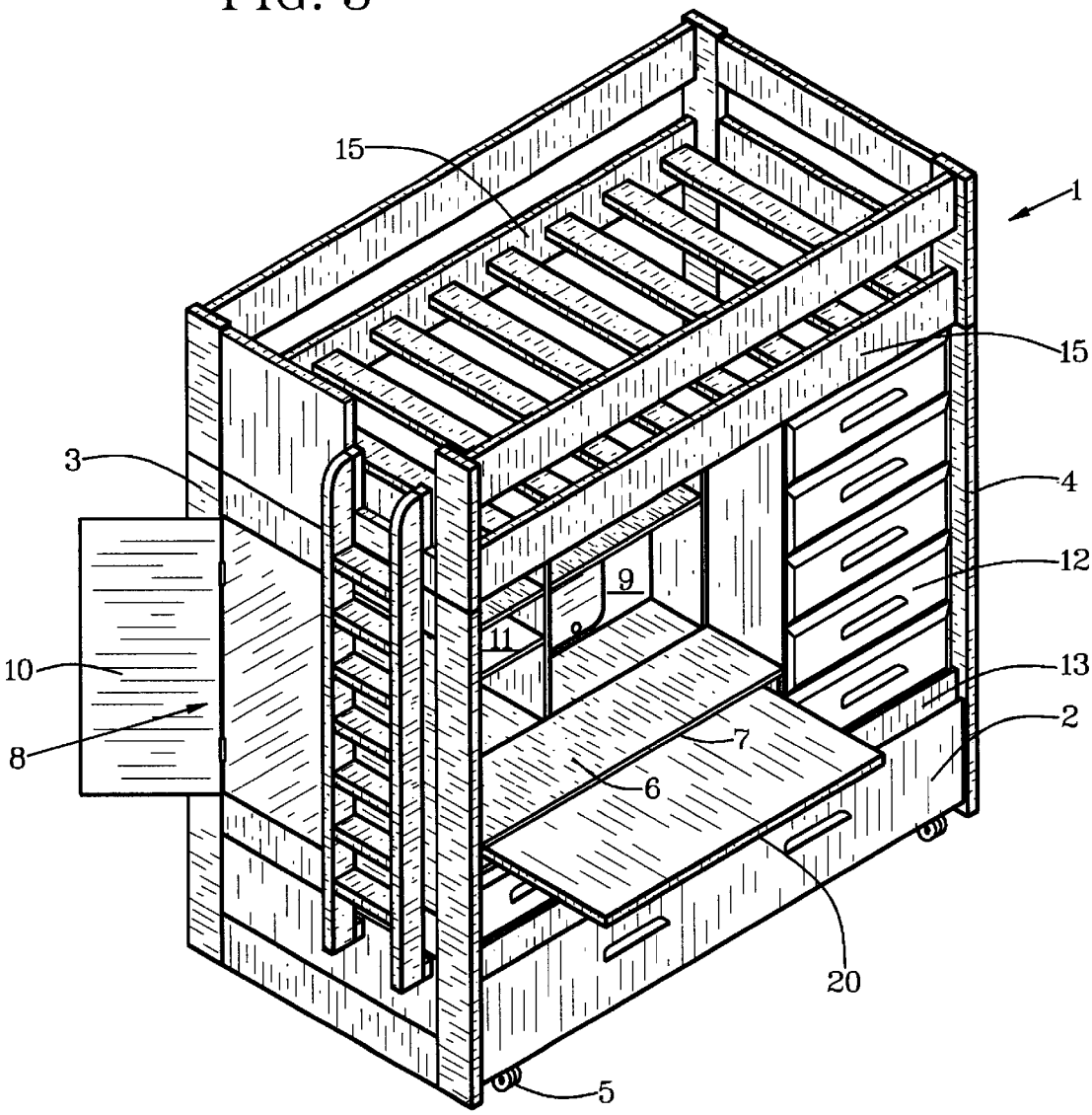
FIG. 3 is the FIG. 2 illustration with a closet door open to reveal closet space and with a desk table pulled out.

As shown in FIGS. 1–3, the drawers 12 can include a plurality of right-side drawers 12 stacked vertically intermediate the trundle bunk 2 and the top bunk 1 above a right-side end of the trundle bunk 2. The drawers 12 can include a plurality of bottom drawers 12 juxtaposed laterally intermediate the first bedstead 3 and the second bedstead 4 and the bottom drawers 12. The bottom drawers can be positioned predeterminedly intermediate the desktop 6 and the trundle bunk 2.

Figure 4:
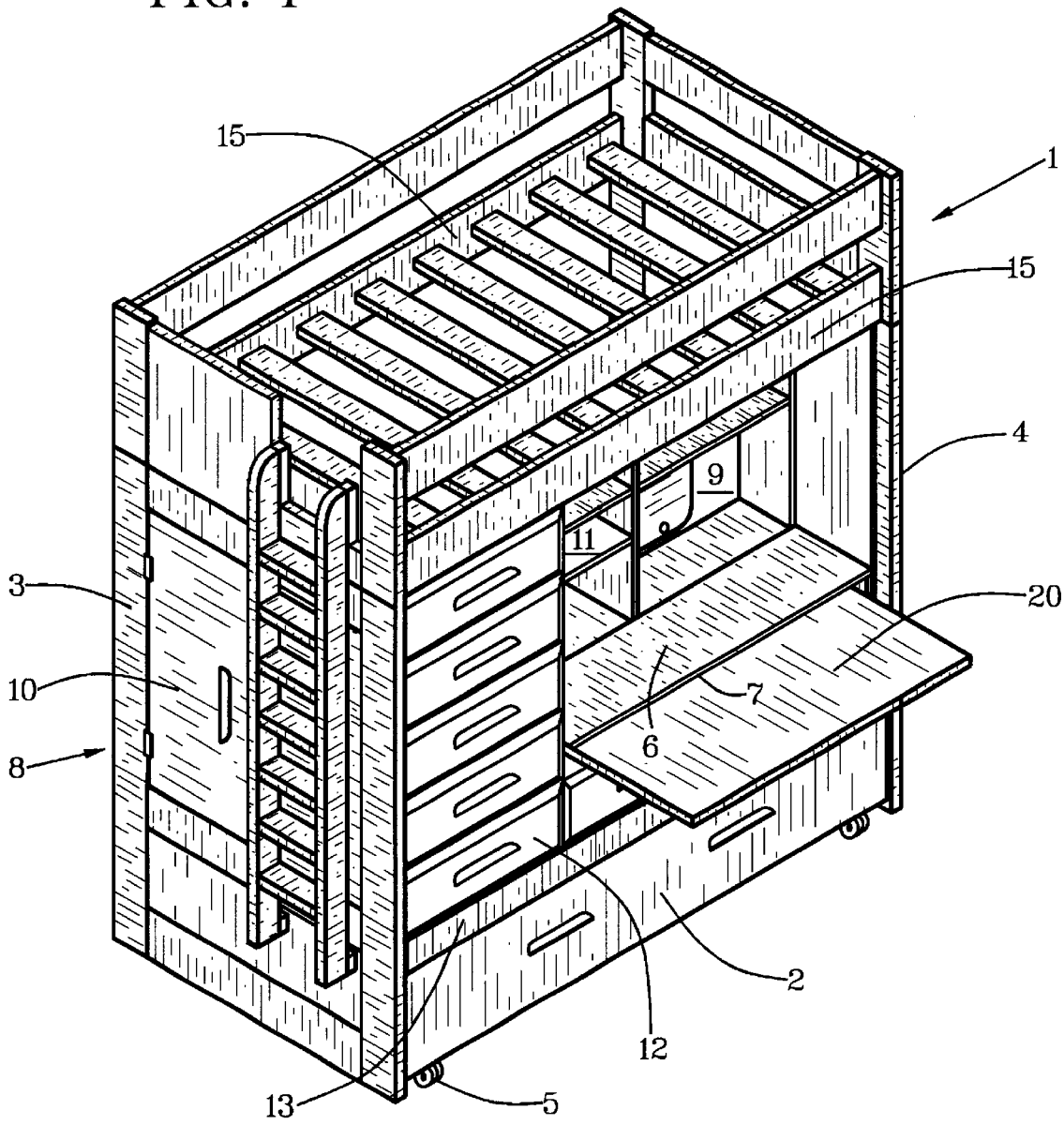
FIG. 4 is a perspective view of an embodiment of the multiple-use bunk bed having left-side drawers and showing the desk table pulled out over the trundle bunk that is rolled under bottom drawers.

As shown in FIG. 4, the drawers 12 can include a plurality of left-side drawers 12 stacked vertically intermediate the trundle bunk 2 and the top bunk 1 above a left-side end of the trundle bunk 2. The drawers 12 can include a plurality of bottom drawers 12 juxtaposed laterally intermediate the bedsteads 3 and 4 with the bottom drawers 12 positioned predeterminedly intermediate the desktop 6 and the trundle bunk 2.

Figure 5:
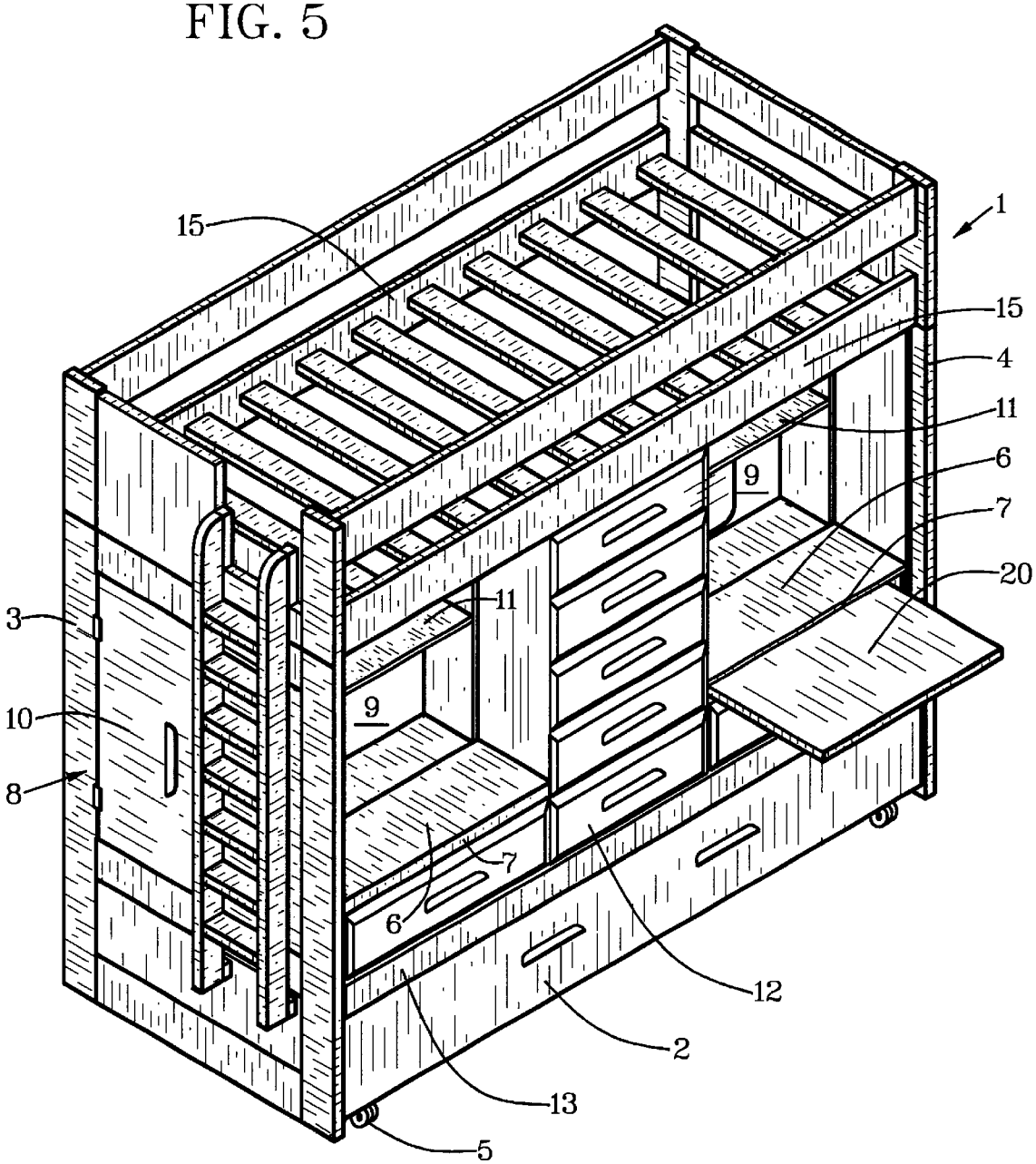
FIG. 5 is a perspective view of an embodiment of the multiple-use bunk bed having center drawers and two desktops showing one desk table pulled out over the trundle bunk that is rolled under bottom drawers.

As shown in FIG. 5, the drawers 12 can include a plurality of central drawers 12 stacked vertically intermediate proximate the trundle- bunk 2 and the top bunk 1 above a central portion of the trundle bunk 2. The desktop 6 can include a left desktop 6 and a right desktop 6. The left desktop 6 is positioned intermediate the first bedstead 3 and a left side of the central drawers 12. The right desktop 6 is positioned intermediate the second bedstead 4 and a right side of the central drawers 12. The left desktop 6 can include a pullout portion 20 that is adapted to be extendable outwardly from the front edge 7 of the left desktop 6. Likewise, the right desktop 6 can include the pullout portion 20 that is adapted to be extendable outwardly from the front edge 7 of the right desktop 6.

As shown in FIGS. 6–7, The drawers 12 can include a plurality of bottom drawers 12 stacked vertically intermediate proximate the trundle bunk 2 and a bottom of the desktop 6 with the drawers 12 juxtaposed laterally intermediate the bedsteads 3 and 4. With stacked drawers 12 under the desktop 6 extending from-side-to-side of the bunk bed, the desktop 6 can include a full-length desktop 6 that is extended intermediate the first bedstead 3 and the second bedstead 4. The full-length desktop 6 also can include a pullout portion 20 that is adapted to be extendable outwardly from the front edge 7 of the desktop 6.

As shown in FIGS. 1–7, 10 and 13, 13, the shelves 11 can include shelves that are adaptable predeterminedly for books, sundry items and computer disks. Also, the shelves can be positioned about a monitor area predeterminedly.

Figure 13:
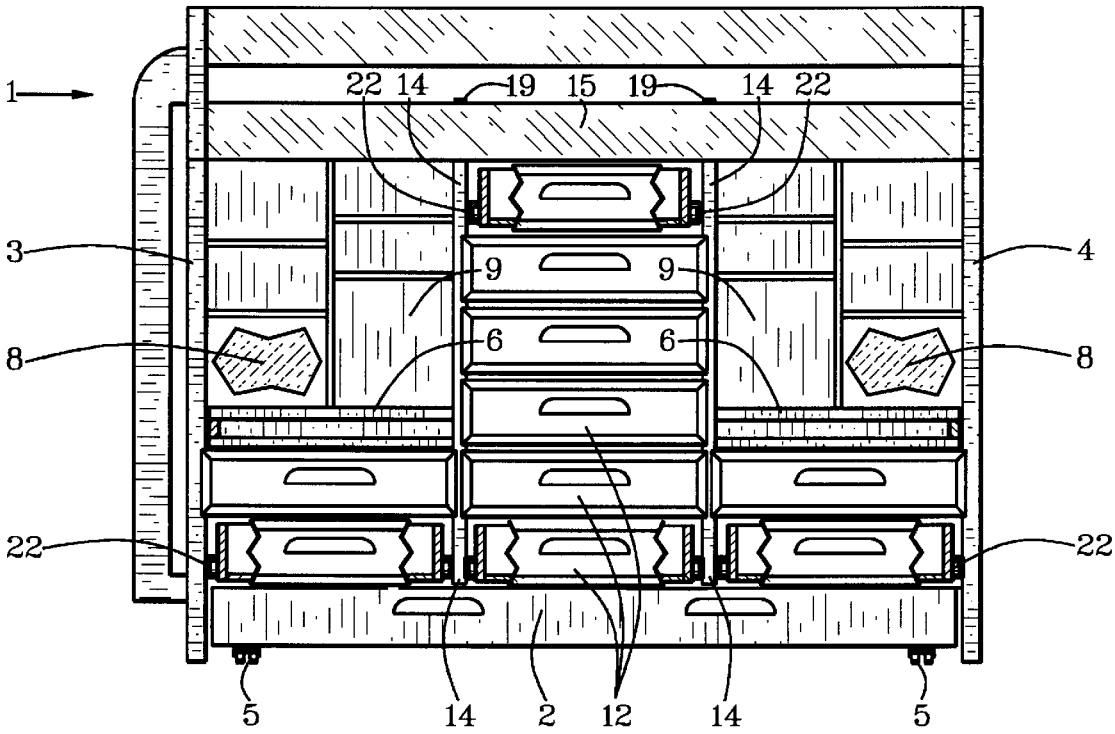
FIG. 13 is a partially cutaway front view of a large size with stacked central drawers, stacked bottom drawers, a dual desktop and shelves supported with hanging-support walls with side attachments.

The drawers 12 supported by the hanging-support wall 14 can include stacked bottom drawers 12 with a full-length desktop 6 and pullout portions 20 as shown in FIGS. 6–7 and center drawers 12 as shown in FIG. 13. Side drawers 12 and pullout portions 20 also can be adapted for the hanging-support wall 14.

Referring generally to FIGS. 1–13, the multiple-use bunk bed includes a predetermined bunk width intermediate the front and the aft sides of the bunk bed. It includes a predetermined bunk length intermediate the first bedstead 3 and the second bedstead 4. The bunk width can include a standard single-bed width of approximately forty inches and the bunk length can include a standard single-bed length of approximately seventy-two inches for general use. This is the most common size for bunk beds generally. However, with people getting taller and with this bunk bed being intended for college-dormitory use and for military-barracks use, there is a need for longer single-bed uses. Although mattresses, mattress covers and other bedding is produced commercially for standard uses, longer single-bed adaptations up to eighty inches are foreseeable for the most common single-bed length as depicted in FIG. 5.

Figure 12:
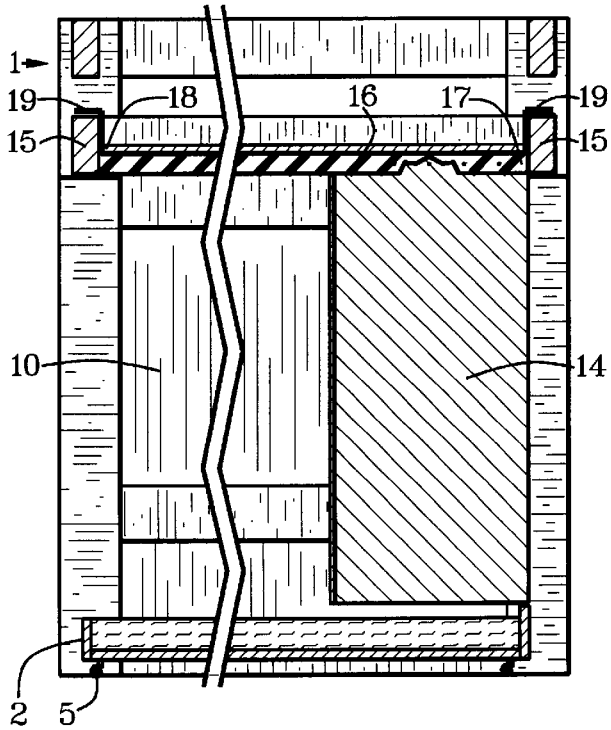
FIG. 12 is the FIG. 11 illustration with optional widening to include fill-size, queen-size, king-size and other selectively sized multiple-use bunk beds.

As shown in FIG. 12, an extended width can be provided with desired increase in width of the closet 8 and optionally desired increase in depth of the desktop 6 and the drawers 12. Width of the closet 8 in proportion to depth of the desktop 6 is achieved by positioning of the center support beam 13 for bottom support and by width of the hanging-support wall 14 for top support. The width of the closet 8 and the depth of the desktop 6 are determined by distance positioning of the central support beam 13 for the embodiments described in relation to FIGS. 1–5 and 8. The width of the closet 8 and the depth of the desktop 6 are determined by width of the hanging-support wall 14 for the embodiments described in relation to FIGS. 6–7 and 9–13.

Referring to FIGS. 6–7 and 9–13, the hanging-support wall 14 is adapted for supporting the desktop 6 with desktop supports 21 and for supporting the drawers with drawer supports 22. The desktop supports 21 can include a selection of known fasteners and brackets. The drawer supports 22 can include a selection of known side-mount drawer runners.

Referring further to FIGS. 1–13, the closet 8 need not have a back wall for clothes-storage purposes if the multiple-use bunk bed is positioned against a wall. None is shown. Angular braces or plates can be employed for structural integrity.

Wide and long multiple-use bunk beds may be a luxury for some users and a necessity for others. This is a personal and an economic factor. All sizes can be produced. A queen-sized or a king-sized multiple-use bunk bed can sleep four people, one of whom on an average basis is likely to be too tall for a six-foot bed. These bed sizes can store their living essentials with increased sizes of the closet 8 and with increased sizes and pluralities of the drawers 12. They can also provide study and computer-use seclusion with central drawers 12. In combination with efficiency-kitchen and bathroom facilities, preferably at least partly secluded from a multiple-use area, they can provide quite comfortable living for students, a small family or other groups in confined areas. For supporting only two people, these large sizes can provide a luxury of personal accommodation and guest accommodation that can make a confined area livable with only a small increase in area size.

Nevertheless, the forty-inch single-bed width and possibly an increased length will likely be the most common size of choice for mostly economic reasons.

FIGS. 12–13 depict size adaptation to queen, king and other larger sizes.

A new and useful multiple-use bunk bed having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A multiple-use bunk bed comprising:

a top bunk and a trundle bunk positioned intermediate bedsteads which include a first bedstead and a second bedstead that are oriented vertically at ends of the bunk bed;

the top bunk including a top-bunk framework positioned intermediate top portions of the bedsteads;

the trundle bunk including casters on which the trundle bunk is adapted to be positioned intermediate a trundle-bunk portion of the bottom of the first bedstead and a trundle-bunk portion of a bottom of the second bedstead in a non-use mode on a floor and to be rolled out from intermediate the bottom of the first bedstead and the bottom of the second bedstead on the floor for a use mode that includes use for sleeping;

at least one desktop positioned vertically above the trundle bunk and under the top bunk;

the desktop having a front edge proximate front edges of the bedsteads;

the desktop having an aft edge predeterminedly rearward from proximate the front edges of the bedsteads;

a closet positioned predeterminedly intermediate aft edges of the bedsteads and an aft edge of the desktop;

the closet having a closet wall proximate the aft edge of the desktop and extended vertically intermediate the desktop and the top-bunk framework;

the closet having a closet door in at least one of the bedsteads;

one or more shelves positioned selectively intermediate the desktop and the top-bunk framework;

a plurality of drawers positioned predeterminedly intermediate the trundle bunk and the top-bunk framework; and a support means adapted predeterminedly for supporting the desktop, the shelves, the drawers and contents thereof above the trundle bed.

2. The multiple-use bunk bed of claim 1 wherein:

the drawers include a plurality of right-side drawers stacked vertically intermediate the trundle bunk and the top bunk above a right-side end of the trundle bunk.

3. The multiple-use bunk bed of claim 2 wherein:

the drawers include a plurality of bottom drawers juxtaposed laterally intermediate the bedsteads; and the bottom drawers are positioned predeterminedly intermediate the desktop and the trundle bunk.

4. The multiple-use bunk bed of claim 1 wherein:

the drawers include a plurality of left-side drawers stacked vertically intermediate the trundle bunk and the top bunk above a left-side end of the trundle bunk.

5. The multiple-use bunk bed of claim 4 wherein:

the drawers include a plurality of bottom drawers juxtaposed laterally intermediate the bedsteads; and the bottom drawers are positioned predeterminedly intermediate the desktop and the trundle bunk.

6. The multiple-use bunk bed of claim 1 wherein:

the drawers include a plurality of central drawers stacked vertically intermediate proximate the trundle bunk and the top bunk above a central portion of the trundle bunk; and the desktop includes a left desktop and a right desktop;

the left desktop being positioned intermediate the first bedstead and a left side of the central drawers; and the right desktop being positioned intermediate the second bedstead and a right side of the central drawers.

7. The multiple-use bunk bed of claim 6 wherein:

the left desktop includes a pullout portion that is adapted to be extendable outwardly from the front edge of the left desktop; and the right desktop includes a pullout portion that is adapted to be extendable outwardly from the front edge of the right desktop.

8. The multiple-use bunk bed of claim 6 wherein:

the drawers include a plurality of bottom drawers positioned intermediate the trundle bunk and a bottom of the desktop; and the drawers are juxtaposed laterally intermediate the bedsteads.

9. The multiple-use bunk bed of claim 1 wherein:

the desktop includes a pullout portion that is adapted to be extendable outwardly from the front edge of the desktop.

10. The multiple-use bunk bed of claim 1 wherein:

the drawers include a plurality of bottom drawers stacked vertically intermediate proximate the trundle bunk and a bottom of the desktop; and the drawers are juxtaposed laterally intermediate the bedsteads.

11. The multiple-use bunk bed of claim 10 wherein:

the desktop includes a full-length desktop that is extended intermediate the first bedstead and the second bedstead.

12. The multiple-use bunk bed of claim 11 wherein:

the desktop includes a pullout portion that is adapted to be extendable outwardly from the front edge of the desktop.

13. The multiple-use bunk bed of claim 1 wherein:

the shelves include shelves that are adaptable predeterminedly for books, sundry items and computer disks.

14. The multiple-use bunk bed of claim 13 wherein:

the shelves are positioned about a monitor area predeterminedly.

15. The multiple-use bunk bed of claim 1 wherein:

the support means includes a set of three support beams juxtaposed intermediate a front side of the bunk bed and an aft edge of the bunk bed;

the three support beams are extended intermediate the first bedstead and the second bedstead to which the three support beams are attachable for support of the drawers, the shelves, the desktop and the contents thereof; and support of the drawers, the shelves, the desktop and the contents thereof being transmitted to bottom portions of the bedstead by attachment of the three support beams to the bedsteads.

16. The multiple-use bunk bed of claim 1 wherein:

the support means includes a set of two support beams juxtaposed intermediate the front side of the bunk bed and the aft edge of the bund bed;

the two support beams are extended intermediate the first bedstead and the second bedstead to which the two support beams are attachable for support of the drawers, the shelves, the desktop and the contents thereof; and support of the drawers, the shelves, the desktop and the contents thereof being transmitted to bottom portions of the bedstead by attachment of the two support beams to the bedsteads.

17. The multiple-use bunk bed of claim 16 wherein:

the support means further includes at least one crosswise support beam secured between the front side and aft edge support beams.

18. The multiple-use bunk bed of claim 1 wherein:

the support means includes a hanging-support wall that is hung from top-bunk beams of the top-bunk framework with at least one wall hanger intermediate the bedsteads; and the wall hanger includes a first end attached to a first top-bunk beam and a second end attached to second top-bunk beam.

19. The multiple-use bunk bed of claim 18 wherein:

the wall hanger includes at least one front attachment member and at least one aft attachment member having tensile strength and strength of attachment to the top-bunk beams for transmitting vertical support for the hanging-support wall to the top-bunk beams.

20. The multiple-use bunk bed of claim 18 wherein:

the drawers include a plurality of bottom drawers positioned intermediate proximate the trundle bunk and a bottom of the desktop; and the bottom drawers are juxtaposed laterally intermediate the bedsteads.

21. The multiple-use bunk bed of claim 20 wherein:

the bottom drawers are adapted for stacking of a plurality of the bottom drawers.

22. The multiple-use bunk bed of claim 1 wherein:

the bunk bed includes a predetermined bunk width intermediate a front and the aft side of the bunk bed; and the bunk bed includes a predetermined bunk length intermediate the first bedstead and the second bedstead.

23. The multiple-use bunk bed of claim 22 wherein:

the bunk width includes a standard single-bed width and the bunk length includes a standard single-bed length for general use.

24. The multiple-use bunk bed of claim 23 wherein:

the bunk width includes a standard single-bed width and the bunk length includes an extended length for tall persons.

25. The multiple-use bunk bed of claim 24 wherein:

the bunk width includes an extended width.

26. The multiple-use bunk bed of claim 25 wherein:

the bunk length includes the extended width.

27. A multiple-use bunk bed comprising:

a top bunk which includes a top-bunk framework intermediate bedsteads comprising a first bedstead and a second bedstead;

a trundle bunk positioned on casters on which the trundle bunk is adapted to be positioned intermediate a trundle-bunk portion of a bottom of the first bedstead and a trundle-bunk portion of a bottom of the second bedstead in a non-use mode on a floor and to be rolled out from intermediate the bottom of the first bedstead and the bottom of the second bedstead on the floor for a use mode that includes use for sleeping;

at least one desktop and a plurality of drawers positioned predeterminedly intermediate the bedsteads;

the desktop and the drawers being positioned vertically above the trundle-bunk portion of the first bedstead and the trundle-bunk portion of the second bedstead bunk;

the desktop having a front edge proximate front edges of the bedsteads;

the desktop having an aft edge predeterminedly rearward from proximate the front edges of the bedsteads;

a closet positioned predeterminedly intermediate a plane of aft edges of the bedsteads and an aft edge of the desktop;

the closet having a closet wall proximate the aft edge of the desktop and extended vertically intermediate the desktop and the top-bunk framework;

the closet having a closet door in at least one of the bedsteads;

a plurality of drawers positioned predeterminedly intermediate the first bedstead and the second bedstead;

the plurality of drawers being positioned predeterminedly above the trundle-bunk portion of the first bedstead and the trundle-bunk portion of the second bedstead; and a support means adapted predeterminedly for supporting the desktop, the plurality of drawers and contents thereof.

28. The multiple-use bunk bed of claim 27 and further comprising:

one or more shelves positioned selectively intermediate the desktop and the top-bunk framework.

29. The multiple-use bunk bed of claim 27 wherein:

the support means includes a hanging-support wall that is hung from top-bunk beams of the top-bunk framework with at least one wall hanger intermediate the bedsteads;

the wall hanger includes a first end attached to a first top-bunk beam and a second end attached to second top-bunk beam; and the wall hanger includes at least one front attachment member and at least one aft attachment member having tensile strength and strength of attachment to the top-bunk beams for transmitting vertical support for the hanging-support wall to the top-bunk beams.

30. The multiple-use bunk bed of claim 27 wherein:

the drawers include a plurality of bottom drawers positioned intermediate proximate the trundle bunk and a bottom of the desktop; and the bottom drawers are juxtaposed laterally intermediate the bedsteads.

31. The multiple-use bunk bed of claim 30 wherein:

the bottom drawers are adapted for stacking of a plurality of the bottom drawers.

32. The multiple-use bunk bed of claim 27 wherein:

the support means includes a set of three beams juxtaposed intermediate a front side of the bunk bed and an aft edge of the bunk bed;

the three beams are extended intermediate the first bedstead and the second bedstead to which the three beams are attachable for support of the drawers, the shelves, the desktop and the contents thereof; and support of the drawers, the shelves, the desktop and the contents thereof being transmitted to bottom portions of the bedstead by attachment of the three beams to the bedsteads.

33. The multiple-use bunk bed of claim 27 wherein:

the support means includes a set of two beams juxtaposed intermediate the front side of the bunk bed and the aft edge of the bund bed;

the two beams are extended intermediate the first bedstead and the second bedstead to which the two beams are attachable for support of the drawers, the shelves, the desktop and the contents thereof; and support of the drawers, the shelves, the desktop and the contents thereof being transmitted to bottom portions of the bedstead by attachment of the two beams to the bedsteads.

34. The multiple-use bunk bed of claim 33 wherein:

the support means further includes at least one crosswise support beam secured between the front side and aft edge support beams.

* * * * *